US007269932B2

(12) United States Patent
Konishi

(10) Patent No.: US 7,269,932 B2
(45) **Date of Patent: *Sep. 18, 2007**

(54) SEALING AND PACKAGING DEVICE FOR COVER FILM ON TRAY

(75) Inventor: Kazuo Konishi, Takatsuki (JP)

(73) Assignee: Ibaraki Seiki Machinery Company, Ltd., Ibaraki-shi, Osaka (JP)

( * ) Notice: Subject to any disclaimer, the term of this patent is extended or adjusted under 35 U.S.C. 154(b) by 7 days.

This patent is subject to a terminal disclaimer.

(21) Appl. No.: 11/091,313

(22) Filed: Mar. 28, 2005

(65) Prior Publication Data

US 2006/0048480 A1 Mar. 9, 2006

(30) Foreign Application Priority Data

Sep. 7, 2004 (JP) ..... 2004-259960

(51) Int. Cl.
*B65B 51/00* (2006.01)
*B65B 53/00* (2006.01)

(52) U.S. Cl. ..... 53/329.5; 53/329.4; 53/556; 53/373.5

(58) Field of Classification Search ..... 53/373.5, 53/373.7, 375.4, 375.6, 287, 329.3–4, 556, 53/329.5

See application file for complete search history.

(56) References Cited

U.S. PATENT DOCUMENTS 3,673,760 A * 7/1972 Canamero et al. ..... 53/433
5,689,937 A * 11/1997 Gorlich et al. ..... 53/433
6,351,928 B2 * 3/2002 Torre ..... 53/556
6,488,972 B1 * 12/2002 Cerani ..... 426/110
6,604,340 B2 * 8/2003 Liao ..... 53/373.7
6,834,476 B2 * 12/2004 Konishi ..... 53/329.5

FOREIGN PATENT DOCUMENTS

JP 2004-203485 7/2004

* cited by examiner

*Primary Examiner*—Rinaldi I. Rada
*Assistant Examiner*—John Paradiso
(74) *Attorney, Agent, or Firm*—D. Peter Hochberg; Sean Mellino

(57) ABSTRACT

A sealing and packaging device in which, simultaneously when a sealing base frame lifted upwards from a lower region towards a flange on the perimeter edge of a tray mounted on a desk plate makes contact with the flange, a touching base provided on a frame of the sealing base frame makes contact with the lower surface of the deck plate, and the tray is pushed upwards towards a cover film by means of the deck plate and sealing base frame, the cover film being welded to the flange of the tray. By means of the upward movement of the tray caused by the sealing base frame and deck plate, breaking of the tray is prevented by the deck plate on which the tray is mounted, even when the tensile pressure of the film or the reaction of urethane rubber members act respectively on the packaged item in the tray.

5 Claims, 9 Drawing Sheets

SEALING AND PACKAGING DEVICE FOR COVER FILM ON TRAY

BACKGROUND OF THE INVENTION

1. Field of the Invention

The present invention relates to a sealing and packaging device, wherein respective individual trays disposed at equidistant intervals in a column fashion, and a band-shaped cover film for the purpose of covering these respective trays, are conveyed at the same speed on a conveyor line, the film being welded successively to an edge flange portion of each tray, while being stretched by a packaged item provided in a mounded fashion on the tray.

2. Description of the Related Art

For example, if a block of chicken meat is accommodated in a tray, then the block of chicken will inevitably rise up about the level of the tray. Therefore, when the mounded block of chicken is sealed inside the tray by means of a cover film, it is necessary to stretch the film when it is welded to the edge flange portion of the tray.

JP 2004-203485A discloses a sealing and packaging device of the following kind. More specifically, a plurality of trays each accommodating a packaged item in a mounded fashion are conveyed at equidistant intervals by a chain conveyor. At an intermediate point of the conveyance path, a cutaway region is formed and a general frame is provided so as to border the region. This general frame moves reciprocally along side rails. A sealing base frame is provided in the general frame below the conveyance path of the trays, and as a result of the sealing base frame moving upwards and downwards, as well as moving back and forth together with general frame, the sealing base frame performs a box motion at the same speed as the trays, due to the combined action of these two movements. Due to the box motion of the sealing base frame, the trays are lifted up above the conveyor, thereby stretching the band-shaped film by means of the packaged item provided inside the trays, and in this state, the film is welded to the flange of the tray. In other words, the sealing base frame on the under side of the chain conveyor repeats an elliptical or rectangular box motion. To provide a simple description of the state of stretching of the band-shaped film by the packaged item due to the box motion of the sealing base frame, if the horizontal path of the chain conveyor is imagined to be the surface of the sea, then the box motion of the sealing base frame is similar to the motion of a dolphin jumping out above the surface in an arc-shaped path. Therefore, due to the box motion of the sealing base frame, the trays rise up above the path of the chain conveyor in an arc-shape, like a dolphin jumping out of the sea. Consequently, the band-shaped film positioned above the conveyor is pushed and stretched by the packaged item mounded inside each tray, and in this state, the flange of the tray is pressed against the sealer disposed above the general frame, thereby welding the film to the flange at the perimeter edge of the tray.

However, in this packaging device, the flange of the tray is supported from below by the sealing base frame, and the weight of the packaged item inside the tray is supported via the flange. Therefore, problems have arisen in that, when the packaged item accommodated in a mounded fashion in the tray pushes and stretches the film disposed above it, the tray supported by the sealing base frame distorts due to the increased tension in the film, the base of the tray develops fractures, or the flange of the tray supported by the sealing base frame breaks.

SUMMARY OF THE INVENTION

The object of the present invention is to provide a sealing and packaging device whereby there is no distortion of the tray, breaking of the tray flange, or fracturing of the base of the tray, when a band-shaped film is pressed and stretched by a packaged item accommodated in a mounded state on a tray, and when the flange portion of the tray is welded.

The sealing and packaging device of the present invention comprises a chain conveyor for pushing and advancing trays at equidistant intervals along a horizontal conveyance path, a general frame moving reciprocally in the direction of travel of the trays within a central cutaway region formed between an upstream conveyance path section and a downstream conveyance path section of the conveyance path, and a deck plate for transferring the trays from the upstream conveyance path section to the downstream conveyance path section. The deck plate is supported on the general frame via leg members, and a sealing base frame surrounding the deck plate moves upwards and downwards by means of a lift in synchronism with the reciprocal movement of the general frame.

Therefore, due to the reciprocal movement of the general frame and the upward and downward movement of the sealing base frame caused by the lift, the sealing base frame performs a box motion. A tray transferred to the deck plate is pushed up together with a packaged item accommodated in a mounded fashion in the tray towards a band-shaped film disposed in an upper region, and the film can be welded to a flange of the tray by pressing the band-shaped film to a sealer supported on the general frame.

In this sealing and packaging device, the deck plate is supported in an upwardly and downwardly movable fashion on a frame formed integrally with the sealing base frame, by means of the leg members. Simultaneously when the sealing base frame during the upward progress makes contact with the lower surface of the tray flange of the deck plate, a touching base provided on the frame makes contact with the lower surface of the deck plate, in such a manner that the deck plate makes close contact with the base surface of the tray while the tray is pushed upwards by the sealing base frame.

By means of this configuration of a sealing and packaging device, the deck plate makes close contact with the base surface of the tray, thereby supporting the base of the tray while the tray is pushed upwards by the sealing base frame towards the band-shaped film and the sealer provided in the upper region. Consequently, even if the tensile pressure of the band-shaped film acts from above on the packaged item accommodated in a mounded fashion in the tray, no localized force will act from above on the flange of the tray supported by the sealing base frame, or on the tray itself, and hence distortion and damage of the tray is prevented and a satisfactory packaged product is obtained.

DESCRIPTION OF THE PREFERRED EMBODIMENTS

Figure 2:
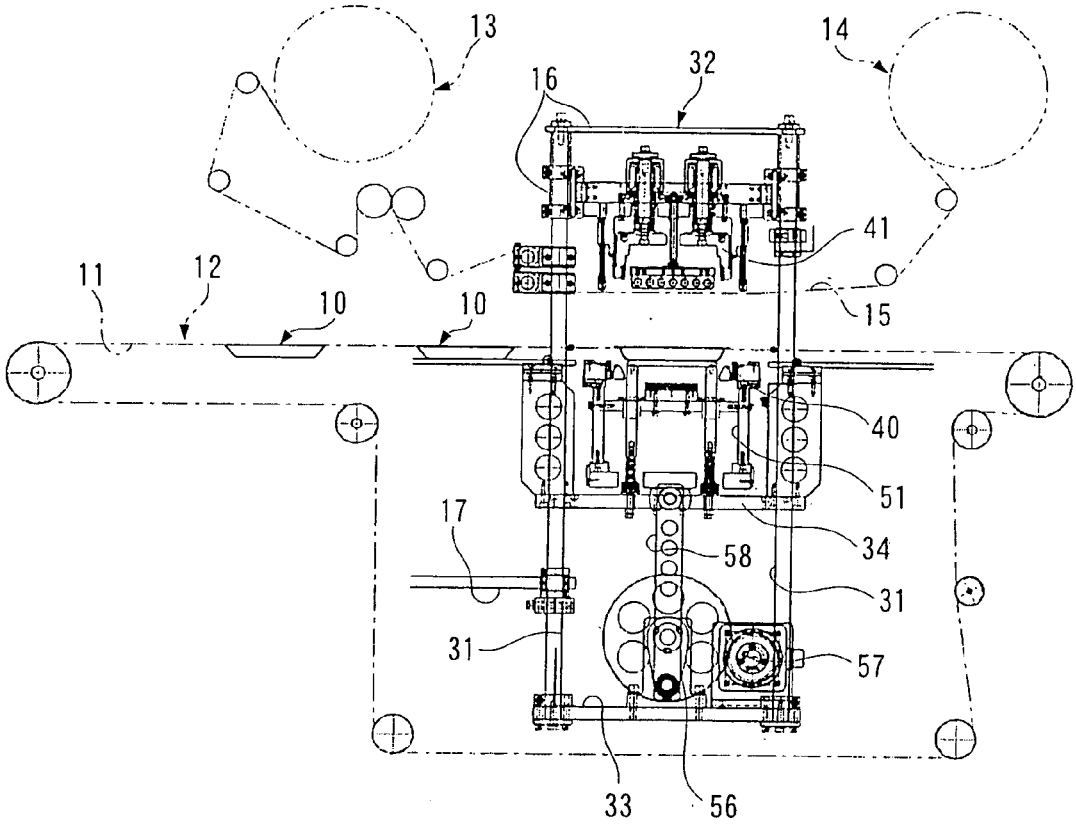
FIG. 2 is a side view of the entire device.

FIG. 2 is a simplified side view showing the general composition of a sealing and packaging device, wherein a chain conveyor 11 supported by a plurality of pulleys conveys a tray 10 holding a packaged item, along a horizontal conveyance path 12. Furthermore, a movement path of a band-shaped film 15 is formed between a pay-out reel 13 and a take-up reel 14 disposed above the conveyance path 12. A general frame 16 disposed in the conveyance path 12 moves back and forth along the conveyance path 12 by means of a rod 17 which transmits the rotational driving force of a crank (not illustrated).

Figure 3:
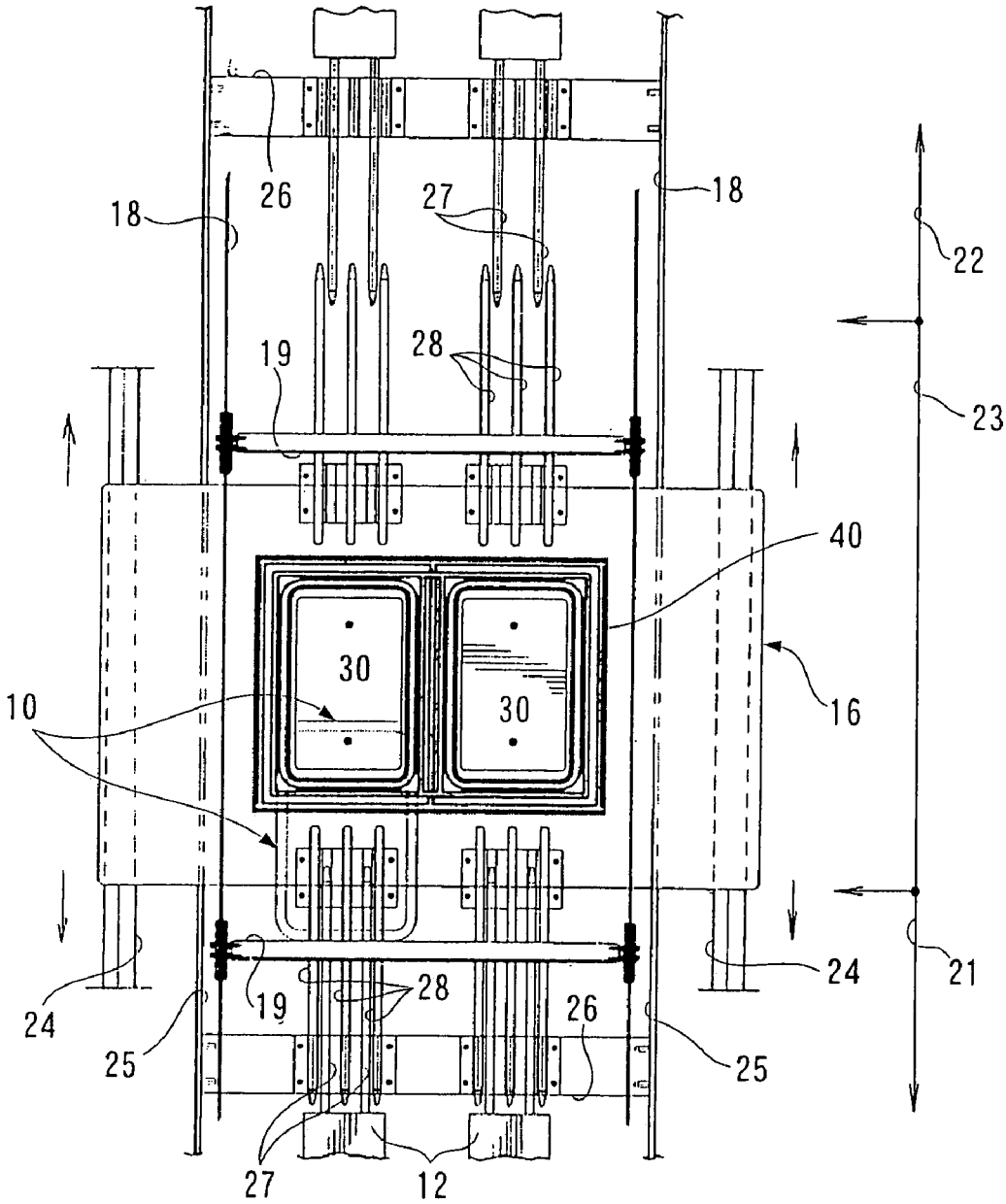
FIG. 3 is a plan view of a conveyance path.

FIG. 3 is a plan view of the conveyance path 12 of the chain conveyor 11, which is composed by spanning touch bars 19 that push the trays 10 and cause them to slide along the conveyance path 12, at equidistant intervals between a pair of endless chains 18 disposed on either side of the conveyance path 12. In the conveyance path 12 along which the trays 10 are conveyed, a central cutaway region 23 is formed between an upstream conveyance path section 21 and a downstream conveyance path section 22, and the general frame 16 is disposed in this central cutaway region 23 in such a manner that it moves back and forth along rails 24 disposed on either side. In this case, the general frame 16 and the endless chains 18 disposed on either side advance at the same speed. Furthermore, stays 26 are provided in a spanning fashion between a pair of side plates 25 disposed on either side of the endless chains 18, and respective pairs of fixed fingers 27 are provided projecting in a symmetrical fashion towards the central cutaway region 23 from respective stays 26, in a forward and rearward position. Furthermore, three movable fingers 28 are disposed facing towards the fixed fingers 27 at the front and rear sides of the general frame 16, and these movable fingers 28 slide forwards and backwards due to the reciprocal movement of the general frame 16, in such a manner that the distance between the fixed fingers 27 and the movable fingers 28 increases and decreases. A tray 10 pushed by a touch bar 19 is slid and conveyed from the upstream conveyance section 21 of the conveyance path 12, over the extended fingers 27 and 28, and furthermore, the tray 10 is transferred onto a deck plate 30, with the fingers 27 and 28 forming a transfer section.

Figure 4:
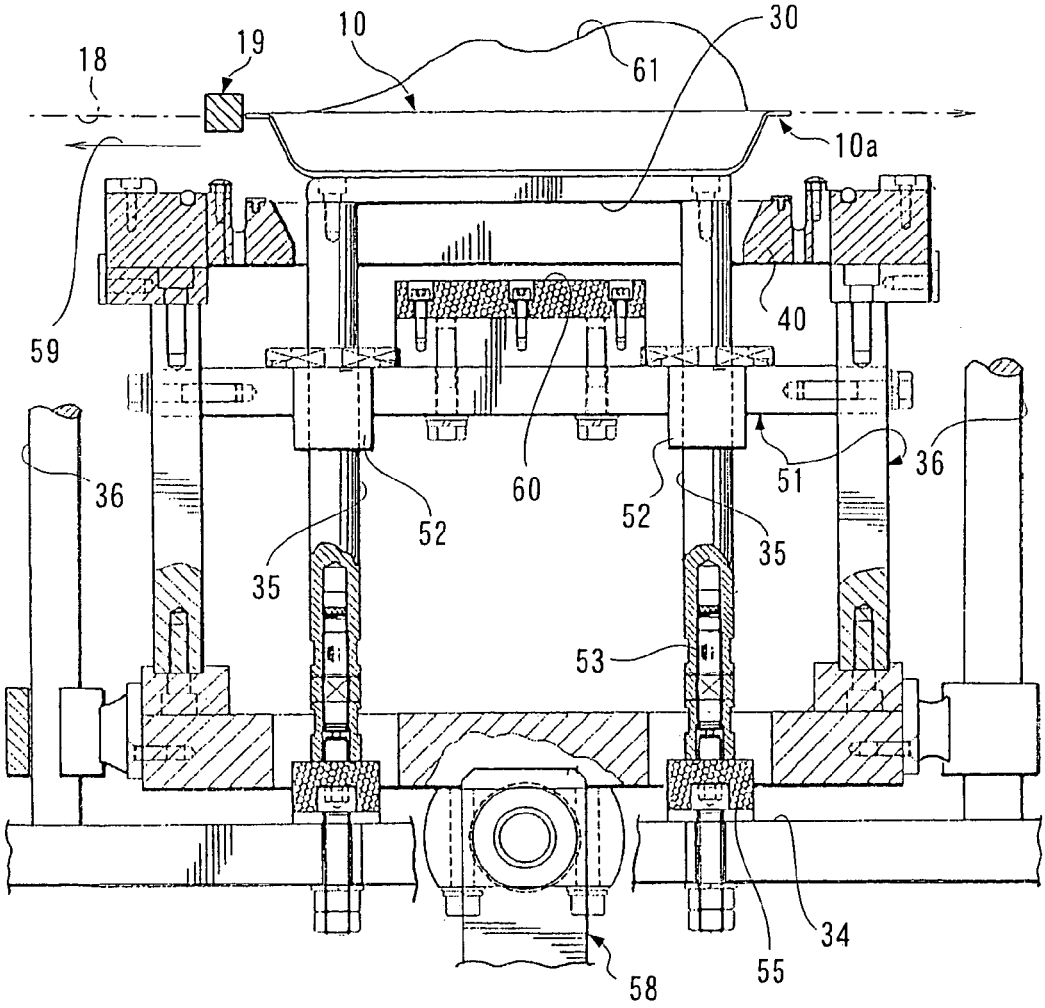
FIG. 4 is an enlarged side view of a sealing base frame.

The basic composition of the general frame 16 in FIG. 2 consists of four pillar members 31 provided in a standing manner in four respective corners, a top plate 32 and a bottom plate 33 provided respectively at the top and the bottom of the pillar members, and an intermediate plate 34 provided in an intermediate position of the pillar members. As shown in FIG. 4, a deck plate 30 supported by two leg members 35 is provided on top of the intermediate plate 34, and a sealing base frame 40 having the same outline as the tray 10 is provided surrounding the deck plate 30. In short, reference numerals 30 in the general frame 16 in FIG. 3 indicate two deck plates disposed in the horizontal conveyance path, and reference numerals 40 indicates a sealing base frame 40 which surrounds these deck plates.

Figure 1:
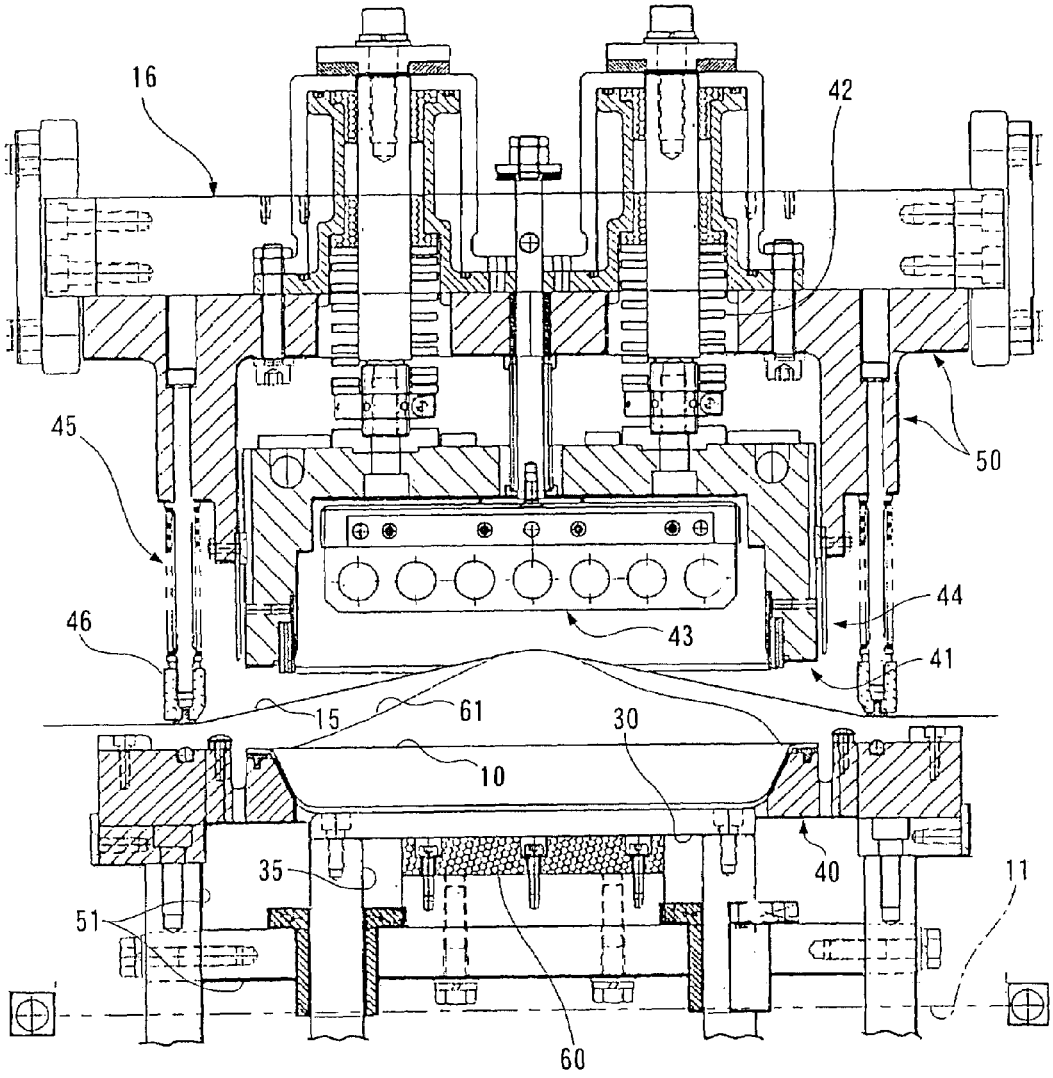
FIG. 1 is a side view of a principal part of a device according to the present invention.

A sealer 41 having the same outline shape as the open edge of a tray 10, in other words, the flange portion of the tray, is supported on the general frame 16 above the conveyance path of the band-shaped film 15 shown in FIG. 2. More specifically, a box-shaped sealer 41 in FIG. 1 is supported via a shock-absorber spring 42 on a supporting body 50 spanned across the upper portion of the general frame, and furthermore, a urethane rubber cushion member 43 is provided inside the sealer 41. Cutting blades 44 are provided so as to surround the sealer 41 on the lower portion of the supporting body 50, and a plurality of film pressing members 46 are provided which are projected downwards by means of springs 45, in a configuration which surrounds the cutting blades 44.

A lower frame 51 supporting the sealing base frame 40 shown in FIG. 4 is provided slidably along guides 36 provided in a standing manner on the intermediate plate 34. (In FIG. 2, there is insufficient room to depict the guides 36, and hence they are omitted from the drawing.) Furthermore, two sleeves 52 fixed to the frame 51 are supported slidably on the two leg members 35 which support the deck plate 30. Shock-absorbing pins 53 are disposed inside the lower end of each leg member 35 and when these pins 53 make contact with a base member 55 provided on the intermediate plate 34, the upper surface of the deck plate 30 rests at approximately the same height as the upstream conveyance path section 21 and the downstream conveyance path section 22, while the upper surface of the sealing base frame 40, in its lowermost position, will be positioned below the upper surface of the deck plate 30. Therefore, it is possible to transfer a tray 10 which has been pushed and conveyed by a touch bar 19 supported on the endless chains 18, onto the upper surface of the deck plate 30.

A motor 57 is provided below the general frame 16 shown in FIG. 2. A crank 56 which is turned by the motor 57 forms a lift for causing upward and downward movement of the sealing base frame 40 and the frame 51 in the upper portion, by means of a con rod 58. Consequently, due to combination of the upward and downward movement of the sealing base frame 40, and the forward and backward movement of the general frame 16 along the conveyance path 12, as described above, the sealing base frame 40 performs a box motion which traces an endless cyclical path. (The touch bar 19 illustrated in FIG. 4 impedes the box motion of the sealing base frame 40, and hence it is previously withdrawn slightly in the direction of arrow 59.)

Figure 5:
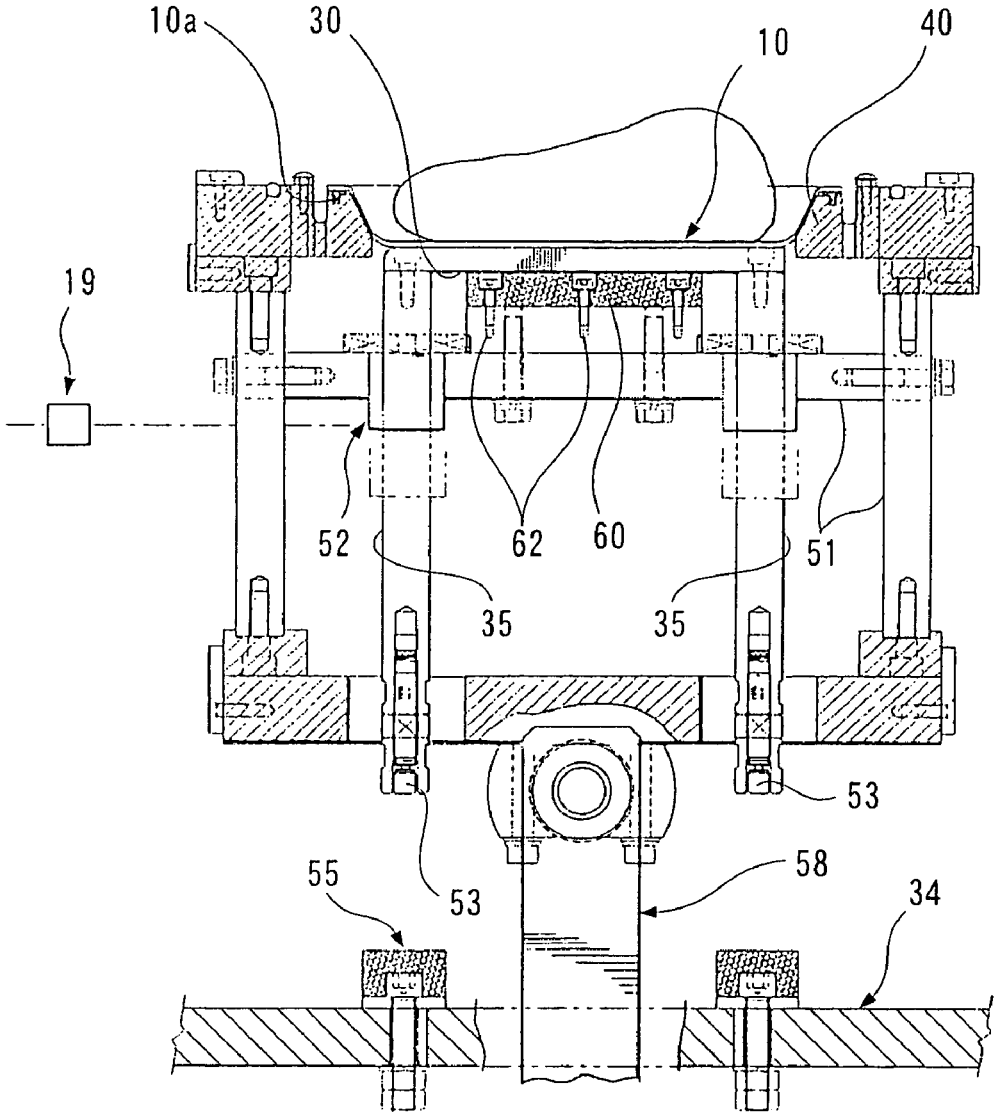
FIG. 5 is an operational view of FIG. 4.

In FIG. 4, when the con rod 58 raises the frame 51 along the guides 36, due to the action of the crank, then as shown in FIG. 5, the upper surface of the sealing base frame 40 makes contact with the lower surface 10*a* of the perimeter flange of the tray 10, and at that same instant, the upper surface of a touching base 60 fixed to the frame 51 makes contact with the deck plate 30. As the frame 51 rises further, the touching base 60 pushes and raises the deck plate 30.

Figure 6:
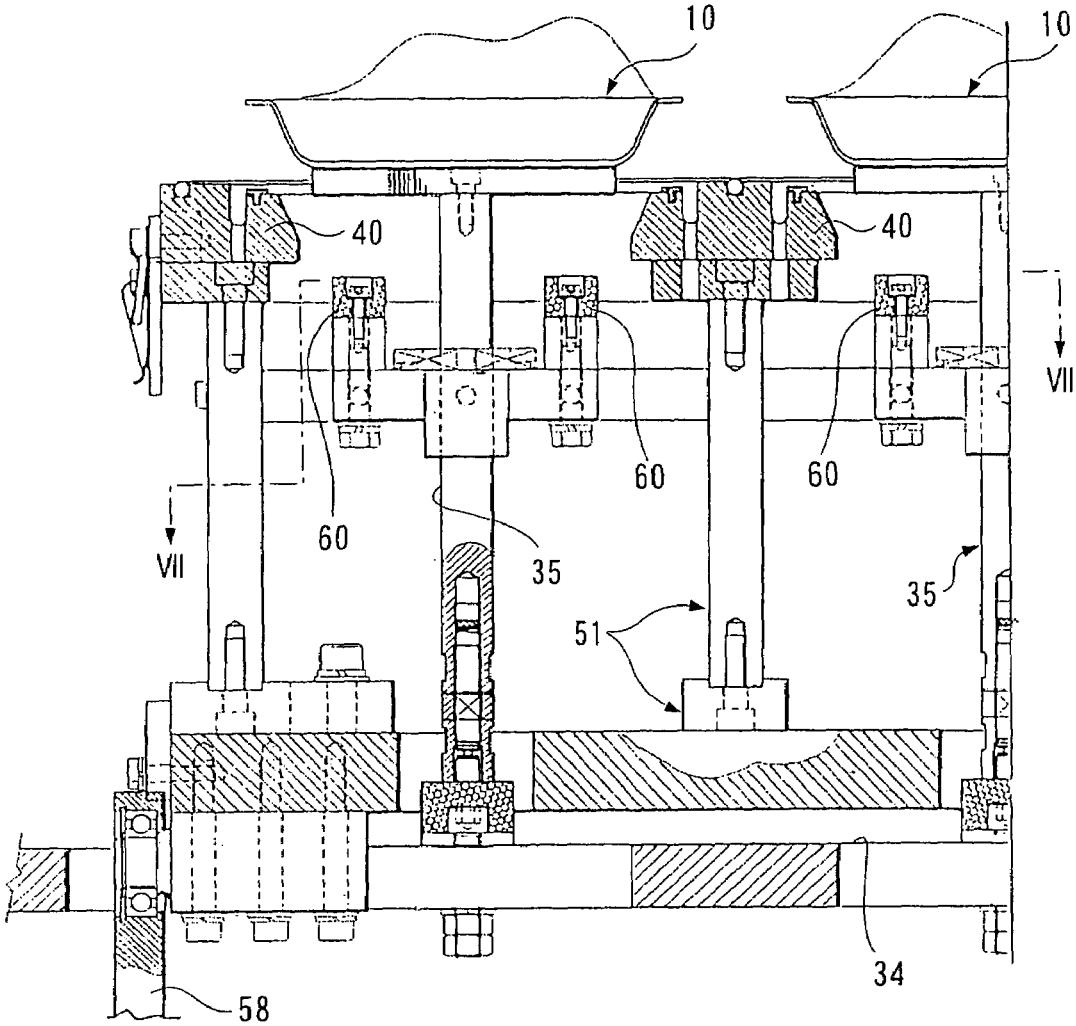
FIG. 6 is a partially cutaway front view of a sealing base frame.
Figure 7:
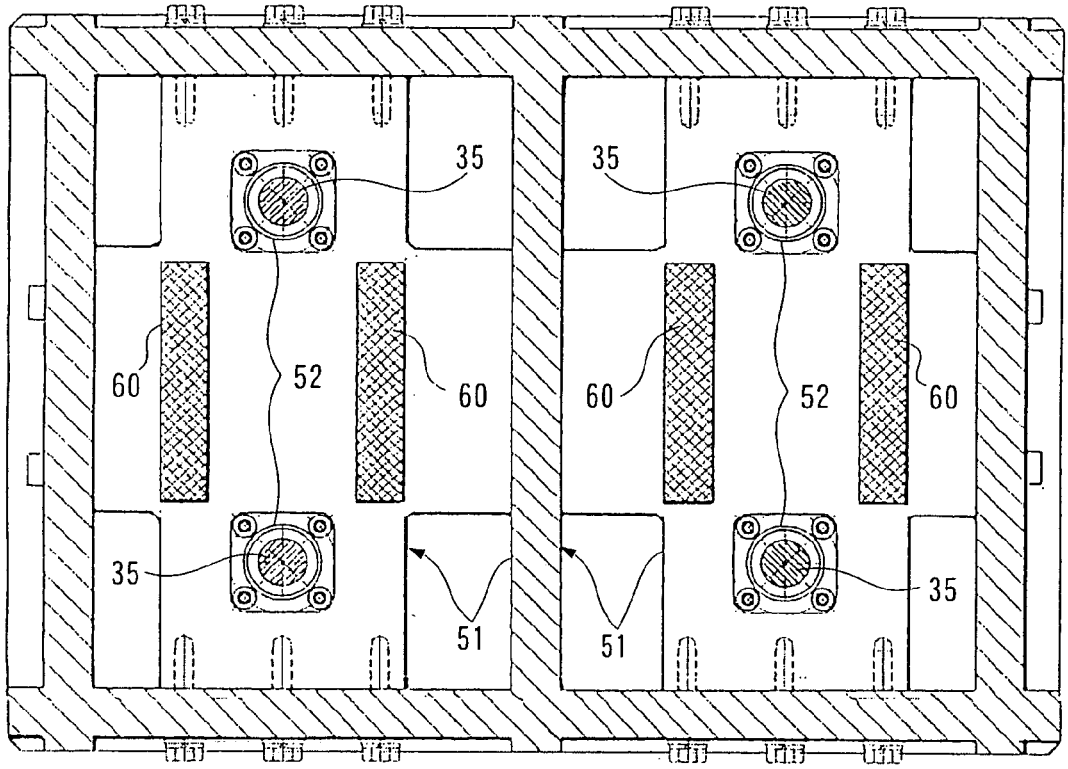
FIG. 7 is a plan view along line VII-VII in FIG. 6.

As shown by the front view in FIG. 6, since trays 10 are processed in a two-column conveyance path 12, four sleeves are provided on a two-column frame 51 which supports the sealing base frame 40, as illustrated in FIG. 7, and four leg members 35, namely two sets of two members each, which are connected to the lower portions of the deck plates 30, are supported slidably on these sleeves. As described previously with respect to FIG. 3, two columns of touching bases 60 are provided respectively on the upper surface of the frame 51.

Figure 8:
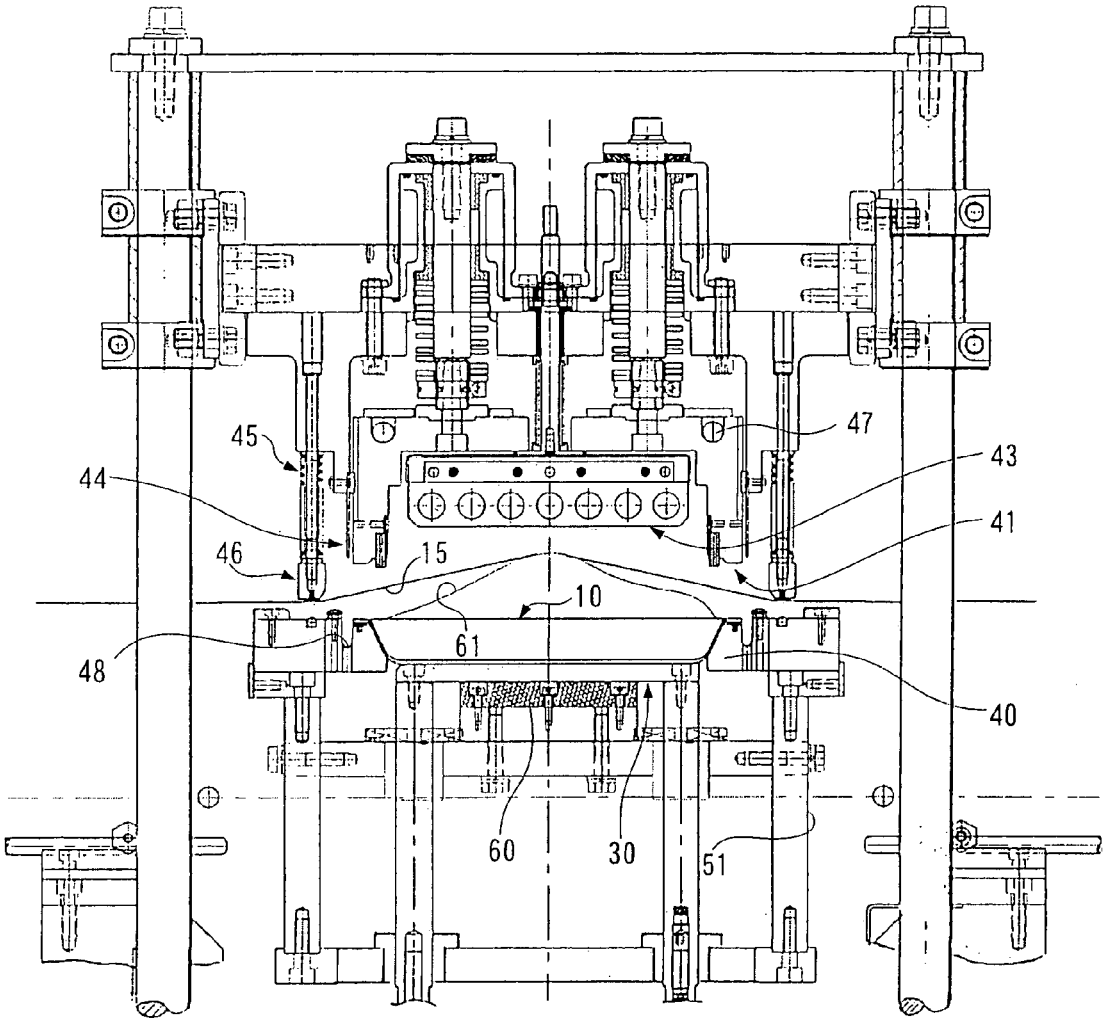
FIG. 8 is a partial side view of the upper portion of a general frame.

FIG. 8 shows a case where a packaged item 61 accommodated in a mounded state in the tray is raised while pushing and stretching the band-shaped film 15. As the sealing base frame 40 which lifts up the tray 10 rises in unison with the deck plate 30, the band-shaped film 15 is lifted up by the packaged item 61 and makes contact with the film pressing members 46. Furthermore, as the sealing base frame 40 rises upwards, the band-shaped film 15 is constricted against the sealing base frame 40 due to the reaction of the springs 45. Simultaneously with this, the sealer 41, which is heated by an electric heating element 47, and the sealing base frame 40 press on either side of the flange of the tray 10 and the band-shaped film 15, and cause them to become welded together. Thereupon, the cutting blades 44, which are inserted into a continuous groove 48 of the sealing base frame 40, cut away the band-shaped film 15 along the outline of the tray 10. In this case, the tensile force of the pushed and stretched band-shaped film 15, or the reactive force of the urethane rubber cushion members 43 disposed in the upper portion act on the tray 10 by means of the packaged item 61, but since the tray 10 and perimeter flange thereof are respectively supported by the deck plate 30 and the sealing base frame 40, then distortion of the tray 10, breaking of the flange and fracturing of the base of the tray 10, are prevented.

As stated previously, as a result of the general frame 16 being advanced and withdrawn through a prescribed area and the sealing base frame 40 performing a repeated raising and lowering motion, the sealing base frame 40 repeats a box motion. The advancing touch bars 19 are withdrawn temporarily during the lifting phase of the sealing base frame 40 only, in such a manner that they do not impede the movement of the sealing base frame 40.

Figure 9:
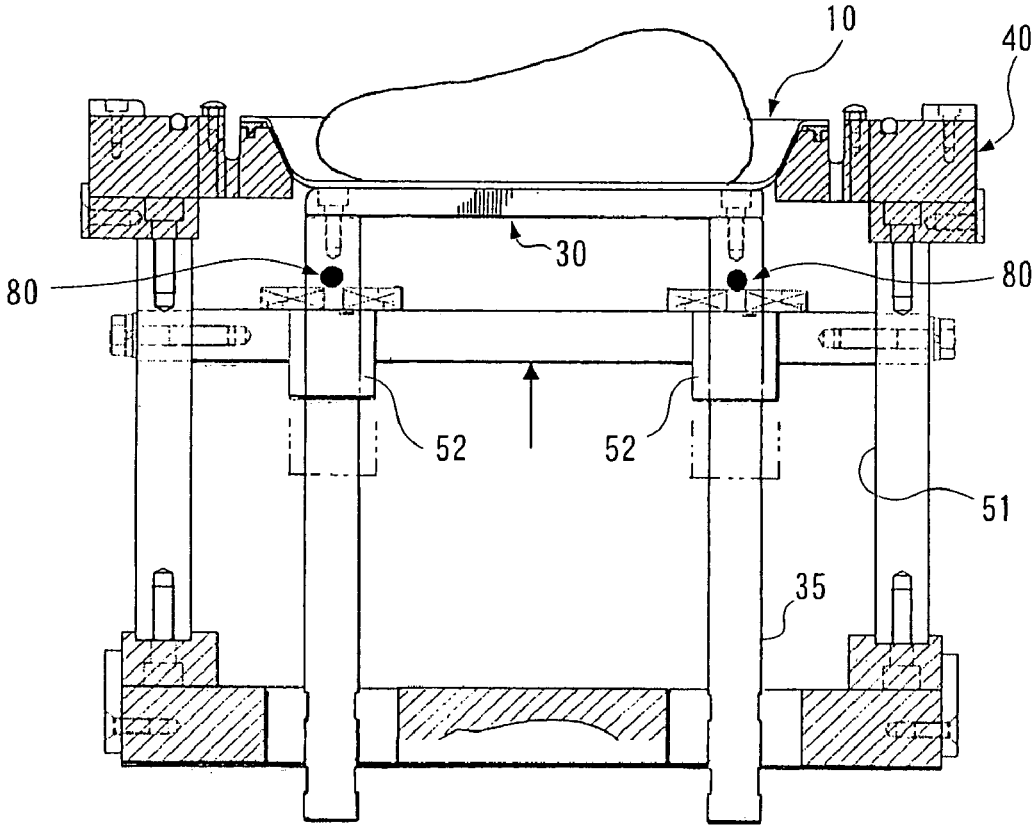
FIG. 9 is an illustrative diagram of another embodiment.

During the raising of the sealing base frame 40, from the state illustrated in FIG. 4 to the state illustrated in FIG. 5, the touching base 60 functions as an attachment which pushes and lifts the deck plate 30. Therefore, in a further embodiment, the sleeves 52 and the frame 51 are taken to be attachments, as illustrated in FIG. 9, and when these attachments 51 and 52 make contact with stoppers 80 provided additionally on the leg members 35, simultaneously, the deck plate 30 makes contact with the lower surface of the tray 10, and the sealing base frame 40 makes contact with the flange of the tray 10, thereby making it possible to achieve the aforementioned objects.

Furthermore, if the height of the tray 10 shown in FIG. 5 is changed, then the screws 62 are loosened, and the touching base 60 is replaced with one of a different thickness, thereby adjusting the height of the tray 10. Furthermore, it is also possible to adopt a composition in which the touching base 60 is moved upwards and downwards by turning screws. A composition may also be adopted in which the positions at which the stoppers are provided on the leg members 35 are displaced in accordance with the height of the tray.

What is claimed is:

1. A sealing and packaging device for sealing a cover film onto a tray, comprising:

a chain conveyor for pushing and advancing trays at equidistant intervals along a horizontal conveyance path;

a deck path for transferring trays from an upstream conveyance path section to a downstream conveyance path section of the conveyance path, the trays being sequentially mounted on the deck plate from the upstream conveyance path;

a general frame moving reciprocally in the direction of travel of the trays within a central cutaway region formed between the upstream conveyance path section and the downstream conveyance path section of the conveyance path, the general frame having leg members for supporting the deck plate; and a sealing base frame disposed on the general frame to surround the deck plate and moving upwards and downwards by means of a lift;

the sealing base frame moving upwards and downwards in synchronism with the reciprocal movement of the general frame, and performing a box motion due to the reciprocal movement of the general frame and the upward and downward movement of the sealing base frame caused by the lift;

the tray mounted on the deck plate being pushed up together with a packaged item accommodated in a mounded fashion in the tray, towards a band-shaped film in the upper region due to the box motion of the sealing base frame, the band-shaped film being welded to a flange of the tray by pressing the band-shaped film to a sealer supported on the general frame, wherein:

the deck plate is supported in an upwardly and downwardly movable fashion on a frame mounted on the general frame and formed integrally with the sealing base frame, by means of the leg members, and simultaneously when the sealing base frame during the upward progress makes contact with the lower surface of the tray flange of the deck plate, a touching base provided on the frame makes contact with the lower surface of the deck plate, such that the deck plate makes close contact with the base surface of the tray while the tray is pushed upwards by the sealing base frame.

2. The sealing and packaging device for sealing a cover film onto a tray as described in claim 1, wherein simultaneously when the sealing base frame makes contact with the lower face of the flange of the tray on the deck plate as it moves upwards due to the lifting mechanism, an attachment provided on the frame of the sealing base frame makes contact with stoppers formed on the leg members of the deck plate.

3. The sealing and packaging device for sealing a cover film onto a tray as described in claim 2, wherein the positions of the stoppers disposed on the leg members can be varied in accordance with the height of the tray.

4. The sealing and packaging device for sealing a cover film onto a tray as described in claim 1, wherein the height of the touching base can be varied in accordance with the height of the tray.

5. The sealing and packaging device for sealing a cover film onto a tray as described in claim 1, wherein the deck plate is supported in an upwardly and downwardly movable fashion on sleeves provided on a frame formed integrally with the sealing base frame, by means of the leg members, and when the sealing base frame is positioned below the conveyance path in which the trays are mounted and conveyed, the deck plate maintains the same height as the conveyance path, whereas when the sealing base frame lifts up the tray containing the packaged item accommodated in a mounded fashion towards the band-shaped film in the upper region, by means of the box motion, the deck plate supports the tray in unison with the sealing base frame.

* * * * *